United States Patent [19]

Rosenfield et al.

[11] Patent Number: 4,480,570

[45] Date of Patent: Nov. 6, 1984

[54] MAINSAIL FURLING MAST ASSEMBLY AND MAST CONSTRUCTION THEREFOR

[75] Inventors: Norman A. Rosenfield, Putnam; Paul M. Rosenfield, Woodstock; Robert H. Jones, Putnam, all of Conn.

[73] Assignee: Metalmast Marine, Inc., Putnam, Conn.

[21] Appl. No.: 432,821

[22] Filed: Oct. 5, 1982

[51] Int. Cl.[3] ..... B63H 9/08; B63H 9/10

[52] U.S. Cl. ..... 114/106; 114/90; 114/104; 114/39

[58] Field of Search ..... 114/90, 104–109, 114/39

[56] References Cited

U.S. PATENT DOCUMENTS

| | | | |
|---|---|---|---|
| 1,613,890 | 1/1927 | Herreshoff | 114/90 |
| 2,561,253 | 7/1951 | Wells-Coates . | |
| 3,331,348 | 7/1967 | Dyer | 114/90 |
| 3,483,840 | 12/1969 | Prölss . | |
| 3,620,182 | 11/1971 | Russell | 114/109 |
| 3,814,835 | 6/1974 | Merry . | |
| 3,835,804 | 9/1974 | Jackson | 114/90 |
| 3,980,036 | 9/1976 | Crall | 114/106 |
| 4,072,121 | 2/1978 | Anderson et al. . | |
| 4,090,461 | 5/1978 | Rusich | 114/90 |
| 4,211,179 | 7/1980 | Saunders . | |
| 4,248,281 | 2/1981 | Hood | 114/106 |
| 4,267,790 | 5/1981 | Hood . | |
| 4,340,005 | 7/1982 | Lagerquist | 114/105 |

FOREIGN PATENT DOCUMENTS

| | | | |
|---|---|---|---|
| 2270142 | 1/1976 | France | 114/90 |
| 1218455 | 1/1971 | United Kingdom . | |

OTHER PUBLICATIONS

"Reefaway" Furling System, Metalmast Marine.
Dyna Furl Literature.
Hood Literature–Stoway Mast.
Hood Literature–Sea Furl System.
Hyde Literature–Stream Stay.

*Primary Examiner*—Trygve M. Blix
*Assistant Examiner*—Edwin L. Swinehart

[57] ABSTRACT

A mainsail furling mast assembly utilizes a mast having a cross section providing a C-shaped outer wall and a transverse wall defining a rearwardly opening compartment in which is disposed a furling element about which the mainsail may be furled. The opening in the mast has a width equal to at least 50 percent of the maximum width of the mast to provide facile access to the compartment. The mast has a boom mounting bracket including a reinforcement portion with a section which extends within the compartment and flange sections which extend forwardly about the outer wall.

23 Claims, 15 Drawing Figures

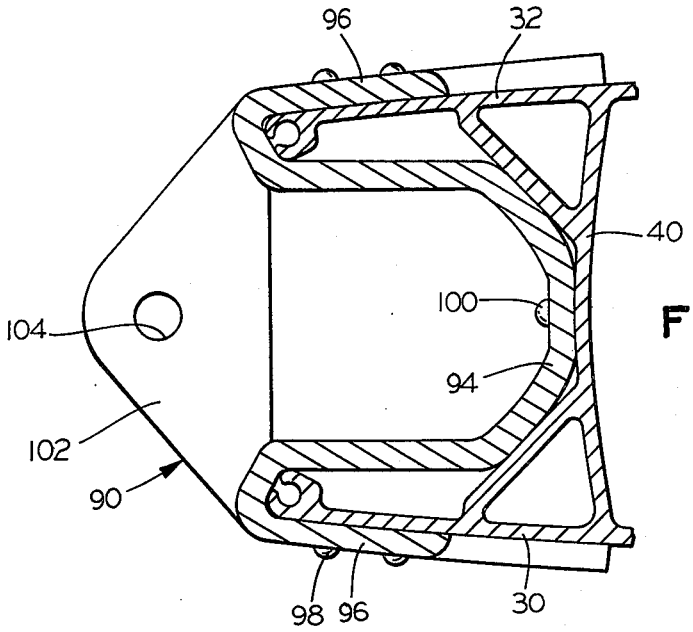
FIG. 13
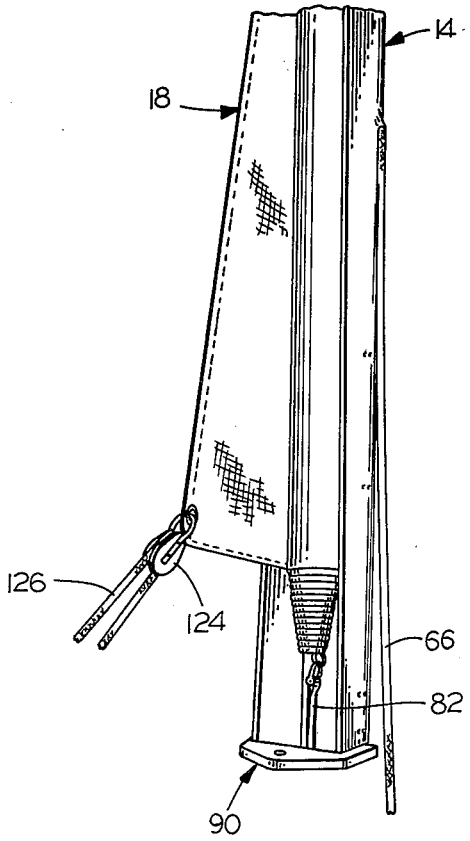
FIG. 12
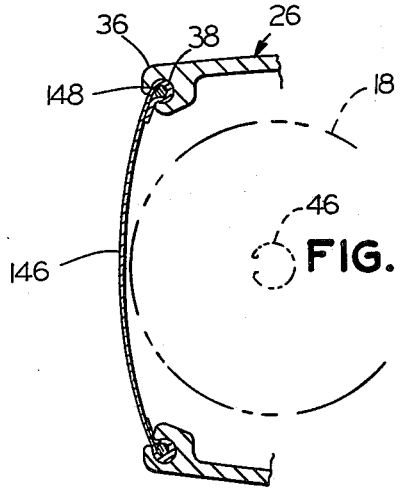
FIG. 14
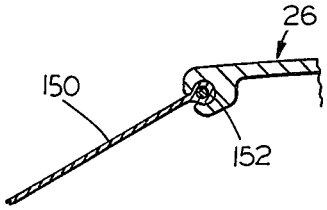
FIG. 15
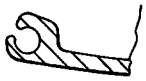

MAINSAIL FURLING MAST ASSEMBLY AND MAST CONSTRUCTION THEREFOR

BACKGROUND OF THE INVENTION

The present invention is directed to mast assemblies which are adapted to furl the mainsail therewithin and to a novel mast construction therefor.

As is well known, it is highly desirable to provide means for reducing the area of the mainsail in use as the velocity of the wind increases, and various techniques have been used therefor. In the roller furling technique, the boom rotates about the gooseneck fitting and the foot of the sail is rolled thereabout as the halyard is lowered. In the slab reefing technique, the sail is provided with one or more lines of horizontal reef points and clew and tack fittings, and the sail is lowered and gathered on the top of the boom at the desired line of reef points. Generally, this requires providing means for engaging a new tack position adjacent the mast and means for providing a downward and aftward force on the clew or aft end of the sail.

More recently, it has been proposed to adapt the now widely employed headsail furling technique to a mainsail and to furl the luff of the mainsail about a furling member extending vertically of the mast in order to reduce the amount of sail. Obviously this requires that the clew or aft end of the sail move forwardly as the sail is vertically furled. It has been proposed to use a mast construction with a cavity having a rearwarly facing slot opening thereinto and through which the mainsail will extend into engagement with a furling member disposed in the cavity. Exemplary of such proposals are the structures shown in Jackson U.S. Pat. No. 3,835,804 granted Sept. 17, 1974; Saunders et al U.S. Pat. No. 4,211,179 granted July 8, 1980; and Hood U.S. Pat. No. 4,267,790 granted May 19, 1981.

Generally such prior furling mast structures have provided a relatively narrow slot in the mast and several have required that the mast furling element be substantially larger in cross section than the width of the slot. As a result, in the event of difficulties with the assembly, access to the furling element and components disposed within the cavity has been substantially limited. Moreover, such mast cross sections have been subject to critical evaluation from a strength standpoint because of the difficulty in providing internal disposition of reinforcing and the need for locating much of the operating mechanism outwardly of the mast.

It is an object of the present invention to provide a novel mast assembly for internally furling the mainsail and which may be readily fabricated and readily serviced.

It is also an object to provide such a mast assembly which is relatively rugged to provide long life and which has the bulk of its operating components disposed within the sail receiving compartment.

Another object is to provide such a mast assembly which includes means for covering the mainsail receiving slot in the mast and thereby protecting the sail from ultraviolet rays and other harmful atmospheric conditions.

A further object is to provide such a mast assembly which includes means for conveniently hoisting another sail adjacent the after end of the mast while the mainsail is furled therewithin or alternate means for hoisting the mainsail.

SUMMARY OF THE INVENTION

It has now been found that the foregoing objects can be readily attained in a mainsail furling mast which utilizes a mast having a cross section defined by a curvilinear outer wall of generally C-shaped configuration and a transverse wall intermediate the length of the cross section. The transverse wall and outer wall define a sail receiving compartment opening at the rear of the mast, which opening has a width equal to at least 50 percent of the maximum width of the cross section of the mast. In the compartment is a sail furling element which is supported at its upper and lower ends therewithin and which is rotatable therewithin. The furling element is substantially smaller in cross section than the width of the compartment opening and may be readily removed therethrough. Means is provided on the sail furling element within the compartment for rotating of the furling element in either direction of rotation.

Preferably, the mast is fabricated in two sections with overlapping sidewall portions secured together. The forward section is substantially U-shaped in configuration, and the rearward section has a cross section defined by a pair of generally curvilinear sidewall portions and a transverse wall portion extending therebetween intermediate the length of the sidewall portions.

Desirably, the mast sections are of substantially equal length in the horizontal dimension. In its preferred form, the cross section includes rearwardly and outwardly extending diagonal reinforcing wall portions at the forward side margins of the compartment. Moreover, the outer wall of the mast may have enlarged rear end portions extending vertically therealong and providing vertically extending slideways having a rearwardly opening slot with an opening of lesser dimension than the cross section of the cavity defined by the slideway.

The mast will normally include a masthead box providing a base plate extending across the upper end of the compartment, and this plate has means depending therefrom which is detachably engaged with the upper end of the furling element. In one type of assembly, a collar assembly is slidable on the furling element and has an upper portion with halyard engaging means thereon and a second portion depending therefrom and rotatable relative to the first portion and with the furling element. This second portion has means thereon for engagement with the head of the sail, so that it may be hoisted upwardly by hoisting of the collar assembly. Conveniently, the furling element is of generally C-shaped cross section providing a vertically extending slot opening into a cavity of greater cross section than the slot for slidably seating the luff of the mainsail.

The assembly will include tensioning means in the compartment below the pulley means and engaged with the lower end of the furling element, and such tensioning means is adjustable to vary the tension on the furling element. Conveniently, the tensioning means comprises a turnbuckle assembly, or it may comprise a hydraulic cylinder and piston/rod element and means for supplying hydraulic fluid to the cylinder at either end of the piston/rod element.

The furling element rotating means will usually comprise a pulley secured on the furling element for rotation therewith, and furling line guide means is provided on the mast including a bracket secured to the mast and extending rearwardly of the mast opening and guide means supported on the bracket in horizontal alignment with the pulley on the furling element.

In its preferred aspect, the mast includes a gooseneck mounting bracket with a reinforcement portion having a section of generally U-shaped configuration extending within the mast compartment with its web portion abutting the transverse wall. Flange sections on the reinforcement portion extend forwardly along the outer surface of the outer wall on both sides of the opening in the mast, and the reinforcement portion is secured to the outer wall of the mast. Desirably, the web portion of the U-shaped section is secured to the transverse wall of the mast. In addition, the gooseneck mounting bracket includes rearwardly extending flanges at its top and bottom ends and providing the gooseneck mounting.

BRIEF DESCRIPTION OF THE DRAWINGS

FIG. 12 is a fragmentary elevational view of the mast adjacent the gooseneck bracket and showing the mainsail substantially furled;

FIG. 13 is a sectional view of the mast along the line 13—13 of FIG. 8 and with the boom removed;

FIG. 14 is a cross sectional view of the mast with a sail cover carried in the slideways and covering the sail opening; and FIG. 15 is a cross sectional view of the mast with another sail hoisted in one slideway.

DETAILED DESCRIPTION OF THE ILLUSTRATED EMBODIMENTS

Figure 1:
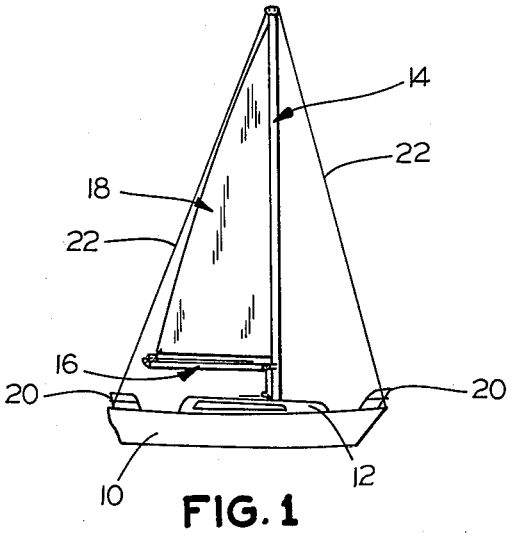
FIG. 1 is a side elevational view of a sailboat employing the new mainsail furling mast design.

Turning first to FIG. 1, therein illustrated is a sailboat having a hull 10, a cabin 12, a mast embodying the new design and generally designated by the numeral 14, a boom generally designated by the numeral 16, a mainsail generally designated by the numeral 18, pulpits 20, and stays 22. For ease of illustration, the foresail, spreaders, shrouds, and lifelines have been omitted.

Figure 2:
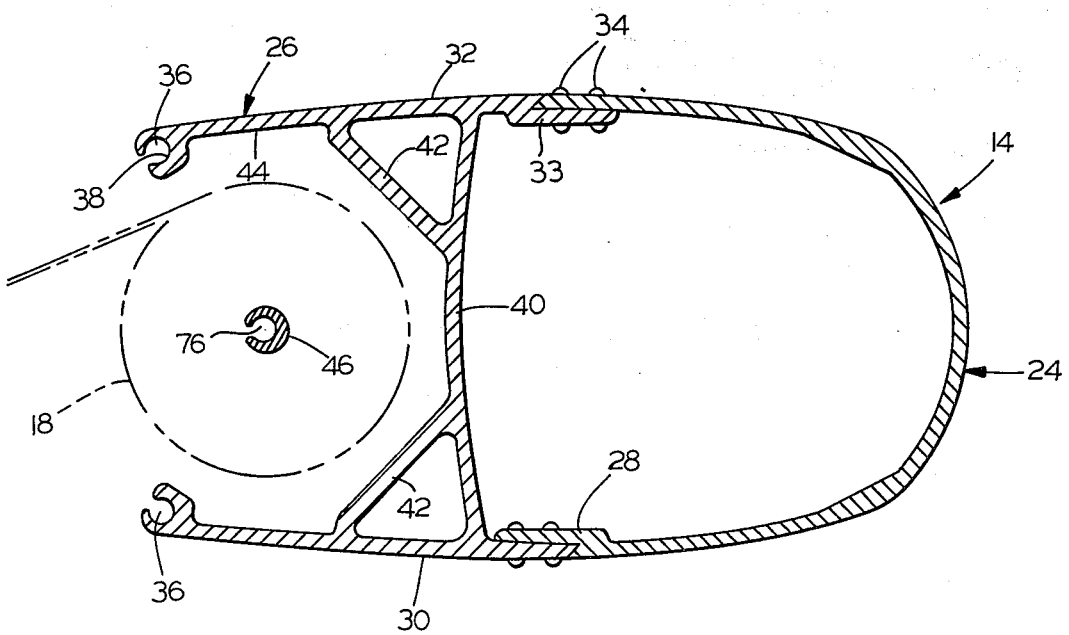
FIG. 2 is a fragmentary transverse cross sectional view of the mast and sail with the mainsail furled therewithin and shown in phantom line.

Turning in detail first to the mast 14 it can be seen in cross section in FIG. 2 as comprising a generally U-shaped forward section generally designated by the numeral 24 and a stiffened rear section generally designated by the numeral 26. The forward section 24 is elongated and has one sidewall portion with an end portion 28 inwardly offset to provide an outwardly facing shoulder. The rear section 26 has a pair of sidewall portions 30, 32 which continue the large radius curve of the sidewalls of the forward section 24, and the forward end of the sidewall portion 30 seats on the shoulder provided by the end portion 28. The forward end of the sidewall 32 is inwardly offset to provide an outwardly facing shoulder upon which is seated the end of the mating sidewall of the forward section 24. As can be seen, the mating transverse surfaces at the ends of the shoulders are inclined inwardly away from the end of their respective end portions, and the ends of the abutting sidewalls are cooperatively inclined to improve the joint therebetween. Rivets 34 are used to secure the overlapping surfaces together.

At their rear ends, the sidewall portions 30, 32 have inwardly and rearwardly opening slideway portions 36 of generally C-shaped cross section and providing generally circular cavities 38. Extending between the sidewall portions 28, 30 intermediate the length of their cross section is a transverse wall 40, and a pair of diagonal reinforcing walls 42 extend rearwardly and outwardly from the transverse wall 40 to sidewall portions 30, 32. The transverse wall 40, diagonal walls 42 and the rearward sections of the sidewall portions 30, 32 define a rearwardly opening compartment 44 within which is disposed the sail furling rod generally designated by the numeral 46 and about which is furled or rolled the mainsail 18, as shown in phantom line. The resultant structure is a sturdy mast section with an enlarged aft facing opening to the compartment 44.

Figure 4:
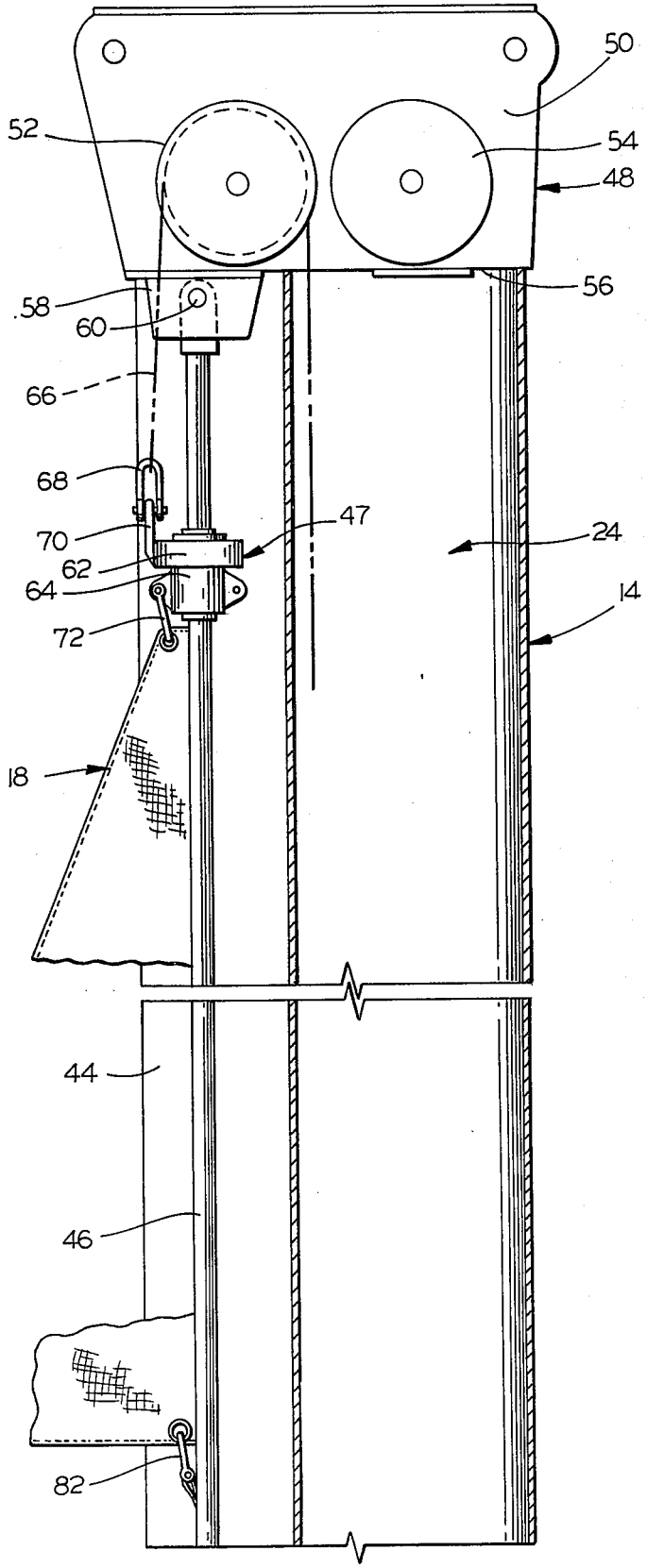
FIG. 4 is a fragmentary vertical sectional view of the mast and sail showing the main halyard in phantom line and with the main unfurled.

As seen in FIG. 4, the masthead box generally designated by the numeral 48 includes a sheave compartment 50 in which are rotatably mounted two pairs of halyard sheaves 52, 54. The transversely extending base plate 56 has mounted thereon an inverted U-shaped mounting bracket 58 depending into the sail compartment 44, and the upper end of the furling rod 46 is secured therein by a clevis pin 60. Adjacent the upper end of the rod 46 is a swivel/bearing connection or bearing support generally designated by the numeral 47 permitting the length of the rod to rotate thereabout. Axially slidable and rotatable on the rod 46 is the head collar 62, and the rotatable sail support collar 64 which is carried by the head collar 62 and which is rotatable with the rod 46 relative to the collar 62.

The main halyard 66 extends about the sheave 52 and into the sail compartment 44 where a shackle 68 at its end is engaged with the upstanding lug 70 on the head collar 62. The head of the sail 18 is in turn secured to the sail support 64 by the shackle 72. The halyard 66 extends downwardly in the compartment defined by the forward section 24 of the mast 14 and exits therefrom adjacent the boom 16 as seen in FIG. 12.

Figure 3:
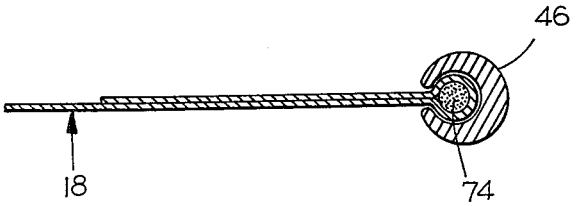
FIG. 3 is a fragmentary sectional view of the sail furling rod and luff of the mainsail drawn to an enlarged scale.
Figure 6:
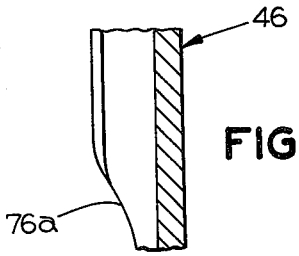
FIG. 6 is a fragmentary sectional view of the mast furling rod showing the enlarged slot for feeding the luff of the sail thereinto.
Figure 7:
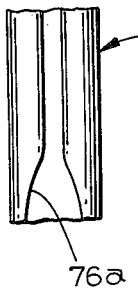
FIG. 7 is a fragmentary rear elevational view of the same portion of the rod.

As seen in FIG. 3, the mainsail 18 has a luffwire, lufftape or luffrope 74 sewn thereinto which stiffens its leading edge and provides a circular cross section which is slidable within the C-shaped slot 76 in the sail furling rod 46. As shown in FIGS. 6 and 7, the rod 46 has an axially extending enlarged slot portion 76 adjacent the boom 16 so that the luff of the mainsail 18 can be fed thereinto.

Figure 5:
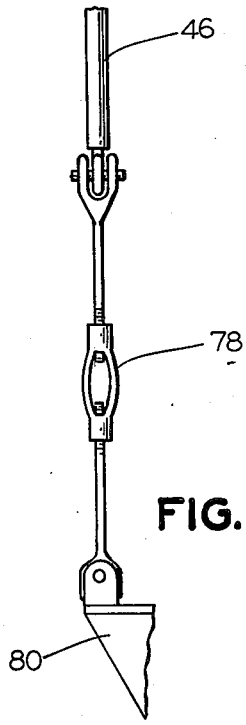
FIG. 5 is a fragmentary view of the tensioning turnbuckle assembly for the sail furling rod.

Turning now to FIG. 5, therein illustrated is the lower portion of the furling rod 46 and the turnbuckle 78 which extends between it and a mounting bracket 80 which is in the sail compartment 44 below the boom 16. In this manner, the tension on the rod 46 may be adjusted, and the rod 46 may also be disassembled for removal from the mast 14.

As shown in FIGS. 4 and 12, the tack of the mainsail is pulled downwardly by the downhaul 82 which extends downwardly in the sail compartment 44, conveniently to a sheave (not shown) and winch (not shown) on the cabin 12 adjacent the step for the mast 14 if deck stepped, or adjacent the collar if keel stepped.

Figure 8:
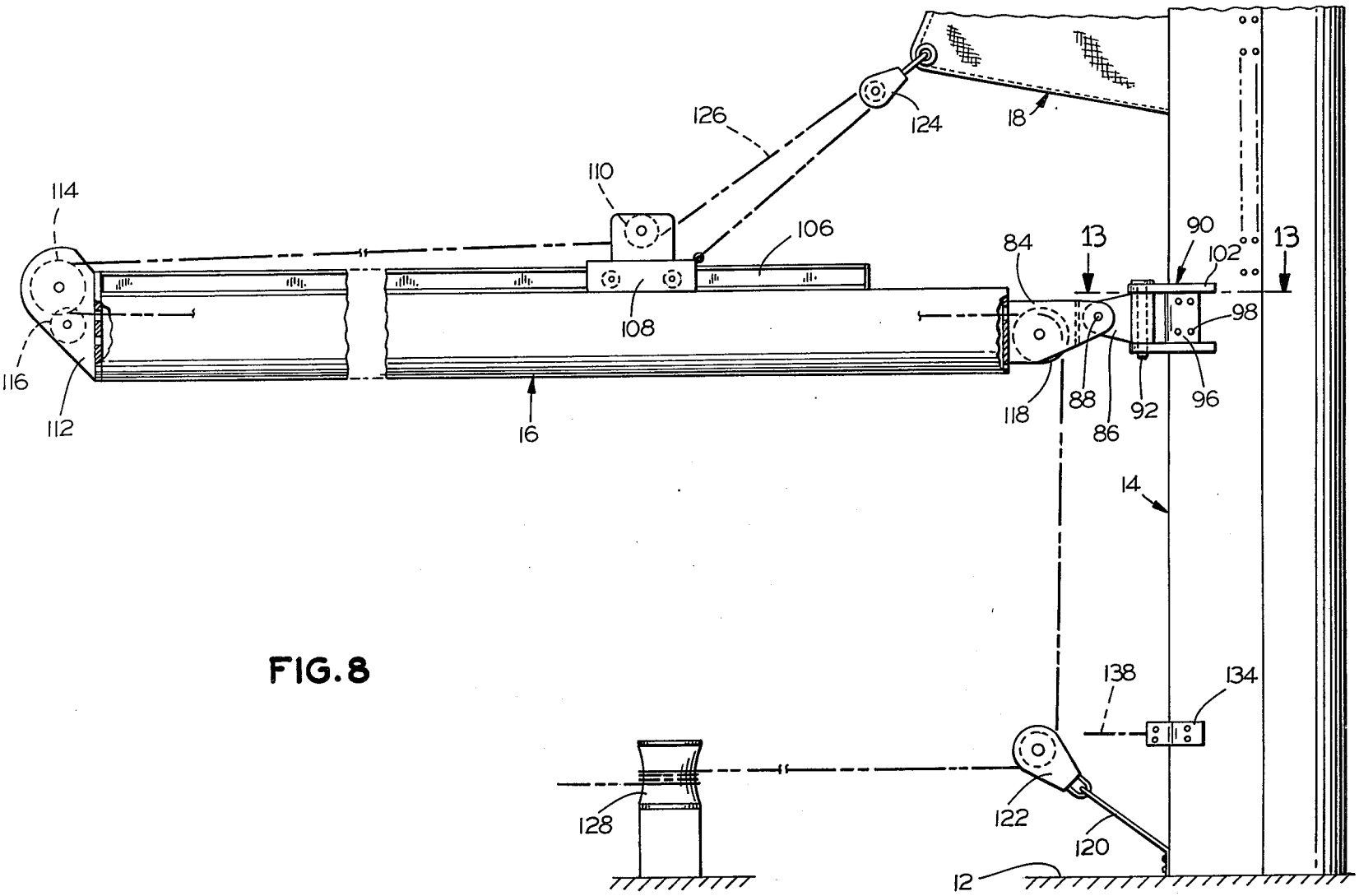
FIG. 8 is a fragmentary side elevational view of the mast and boom assembly with the mainsail substantially fully furled and with the sail outhaul line shown in phantom line.

Turning now to FIG. 8, the boom 16 is of tubular construction and its forward end has an elongated pair of arms 84 which are secured to the gooseneck 86 by the clevis pin 88. The gooseneck 86 is pivotally supported by the pivot clevis 92 for pivoting about a vertical axis on the support bracket generally designated by the numeral 90. As seen in FIG. 13, the support bracket 90 is an integral unit comprised of a vertically extending stiffening portion having a U-shaped center section 94 which extends within the sail compartment 44 and a pair of outwardly and forwardly extending flange sections 96 which fit closely about the sidewall portions 30, 32 of the mast 14. The flange sections 96 are secured to the sidewall portions 30, 32 by rivets 98, and the web of the U-shaped center section 94 is secured to the transverse wall 40 by rivets 100 or other suitable fasteners, thus providing a highly stable assembly and reinforced mast section to accomodate the loads and stresses applied by or through the boom 16. At the upper and lower ends of the bracket 90 are rearwardly extending support arms 102 having aligned apertures 104 through which the pivot clevis 92 extends.

Returning to FIG. 8, the boom 16 has a track 106 extending along its upper surface upon which is slidable the car 108 which supports a sheave 110 for rotation thereon. At its aft end the boom 16 has a bracket assembly 112 which supports a sheave 114 and idler 116 therewithin. At the forward end between the boom arms 92 is rotatably mounted another sheave 118. On the mast adjacent the cabin top 12, a support bracket 120 extends upwardly and rearwardly and carries a turning block 122 in alignment with the sheave 118.

Fixed to the forward end of the car 108 is one end of the outhaul line 126 which extends through the a block 124 attached to the clew of the mainsail 18, around the sheave 114 at the aft end of the boom 16, forwardly through the hollow boom 16, and around the sheave 118, downwardly to and around the turning block 122 and around the winch 128. By pulling on the free end of the outhaul line 126, the clew of the sail 18 can be pulled aft, aiding the sail 18 in unfurling from the rod 46 and additionally ensuring that it is properly tensioned for the amount of extension.

Figure 9:
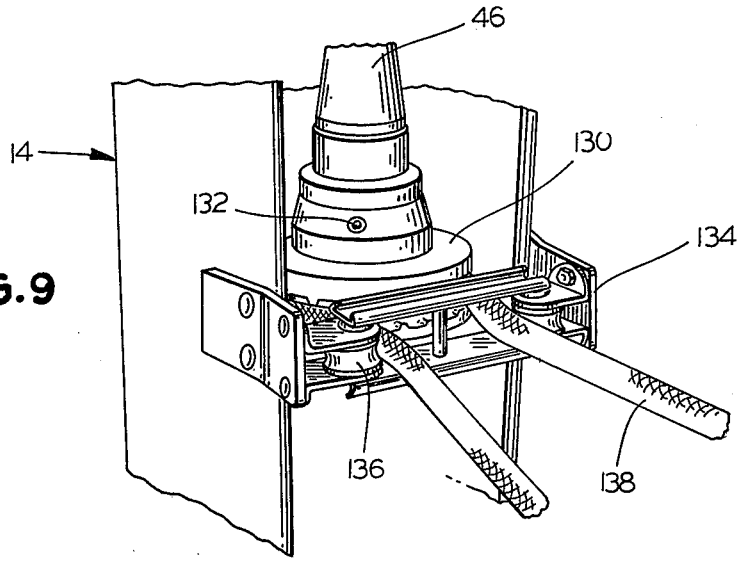
FIG. 9 is a fragmentary rear perspective view of the mast showing the furling rod and furling sheave subassembly.
Figure 10:
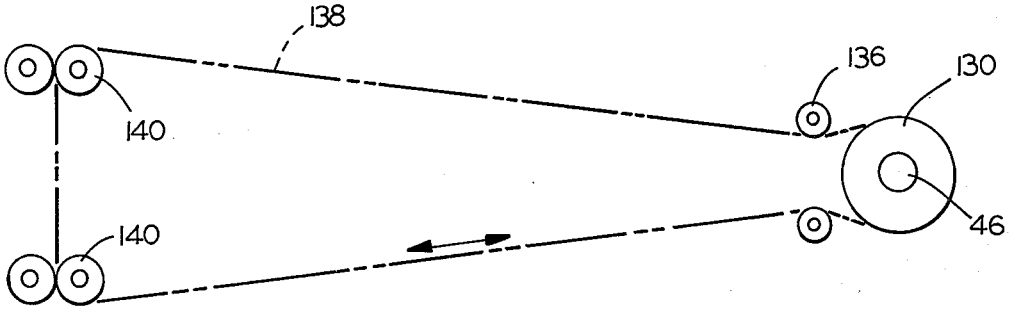
FIG. 10 is a diagrammatic view of the furling line, sheaves and cleats.

Turning now to FIGS. 9 and 10, therein illustrated is the furling pulley and line assembly which in the illustrated embodiment is located adjacent the top of the cabin 12 and below the boom 16. The continuous sail furling rod 46 is provided with a line engaging pulley 130 which is secured thereto in fixed axial position by set screws 132 or the like. A bracket 134 is secured to the mast 14 and rotatably supports two idler pulleys 136 in horizontal alignment with the pulley 130. Extending about the pulley 130 and idler pulleys 136 is the continuous sail furling line 138 which extends aft on the cabin top 12 and is secured in the jam cleats 140.

Figure 11:
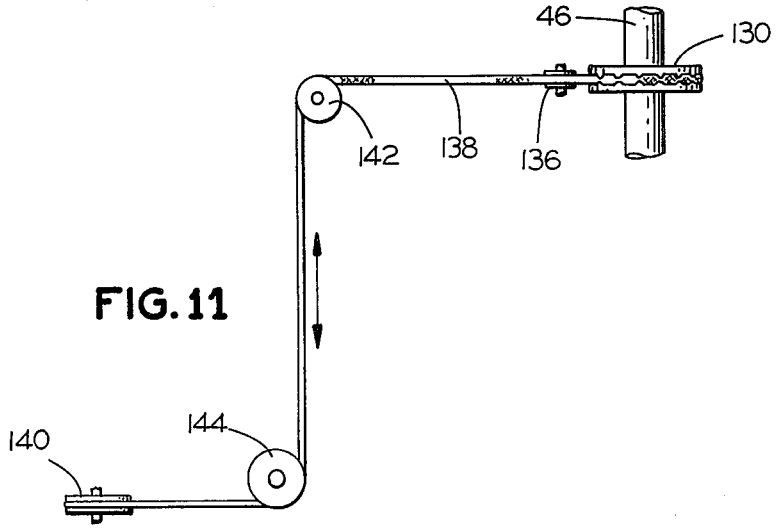
FIG. 11 is a diagrammatic view of an alternate arrangement for the furling line and sheaves.

In the embodiment of FIG. 11, the pulley 130 is disposed adjacent the boom 16 and which supports a pair of turn around blocks 142, and a pair of turnaround blocks 144 are mounted on the cabin top 12. The line 138 thereafter continues about the sheaves 140 as in the prior embodiment. If so desired, the turnaround blocks 142 may be mounted on an extension of the bracket 134 so as to reduce the spacing of the furling line 138 from the mast 16. In this manner, the assembly is readily adapted to a deck stepped mast as will be explained more fully hereinafter.

In FIG. 14, one of the uses of the slideways 36 in the aft end of the mast 16 is illustrated. A sail cover generally designated by the numeral 146 has luff tapes 148 sewn into its vertical edges, and the enlarged edge portions are fed into gates (not shown) in the slideways 36 adjacent the boom 16. A halyard (not shown) is attached to the upper end of the sail cover 146 and used to hoist the sail cover 146 up the mast so as to cover the furled mainsail 18 and protect it from radiation and other atmospheric degradation.

In FIG. 15, another use of the slideways 36 is illustrated. Here another sail generally designated by the numeral 150 (such as a trysail or a lightweight mainsail) has a luff tape 152 sewn into its luff, and it is similarly fed into the slideway 36 and hoisted aloft by a halyard (not shown). In this instance, the outhaul block 124 and outhaul line 126 may be removed from the mainsail 18 and attached to the clew of the sail 150.

In operation, the mast furling assembly of the present invention is relatively simple to use and to maintain. In the initial assembly, the luff of the mainsail 18 is fed into the slot 76 of the sail furling rod 46 at its enlarged portion **76*a*, and its head is secured to the sail support 64 of the head collar 62 by the shackle 72. The halyard 66 is slowly raised as the luff of the mainsail 18 is being fed into the slot 76 to the extent necessary to permit its full insertion thereinto. The tack of the mainsail is then secured to the shackle 82 of the downhaul. The clew is secured to the boom 16 by placing the block 124 in the clew fitting, and the sail may then be extended by drawing on the outhaul line 126 until the mainsail has reached the desired point of extension and tensioning. During the extension of the sail into the fully extended position, the furling line 138** should be left loose.

With the mainsail fully extended, the tension on the sail furling rod 46 may be adjusted to the desired degree by rotation of the turnbuckle 78 which will draw downwardly the rod 46 and its pulley assembly 130.

When it is desired to furl the sail, the furling line 138 is pulled in either direction of rotation depending upon the tack to rotate the furling rod 46 and cause the mainsail 18 to roll thereabout as it rotates. As previously indicated, the sail support 64 of the collar assembly 62 will rotate with the rod 46 in the bearing support 47 while the head collar 62 remains essentially stationary in terms of rotation. Concurrently, the outhaul line 126 must be allowed to feed in the reverse direction so as to allow the clew of the sail to move forwardly towards the mast.

In the event that some mishap should occur causing the mainsail to jam within the sail compartment, it can be seen that the relatively large opening in the aft end of the mast will permit access to the sail and the furling rod to permit manipulation of the components and relief of most problems. Should it be necessary, it can be seen that the rod and mainsail assembly in its entirety may be removed from the sail compartment with the mast fully erect and assembled by releasing the clevis pin at the base of the rod at the turnbuckle or other tensioning means and thereafter removing the clevis at the top of the rod. This will permit the upper end to pivot in the aft direction and the lower portion of the rod to be lifted upwardly and outwardly of the opening in the mast at a point above the boom. Moreover, it can be seen that the large opening permits facile access to the manual means for tensioning the rod disposed fully within the sail compartment of the mast, and the large opening also permits ready access to the furling pulley in the event that any of its components should require attention. Thus, a readily serviceable and easily maintainable assembly of operating parts is provided.

In the illustrated embodiment, the mast has been shown as fabricated in two sections which is preferred for masts of larger dimension. The manner of asembling the two sections shown in the illustrated embodiment provides a highly secure and rigid assembly. However, for a smaller mast cross section, the mast may be generated as an integral extrusion having substantially the same cross section as shown in FIG. 1 with the transverse wall and reinnforcing diagonal struts. Moreover, although aluminum alloys will normally be employed, composite materials using reinforcing fibers may also be utilized.

It can be seen that the mast cross section provides a desirable air foil shape while also creating the large opening at the aft end of the mast. This opening in the mast should have a dimension equal to at least 50 percent of the maximum transverse dimension of the mast cross section, and preferably the opening is on the order of 65–75 percent of that dimension.

The furling rod and support assembly utilized in the mast oonstruction of the present invention may be any of the several currently in use to furl foresails although some modification may be required with respect to the furling pulley and/or tensioning means to permit their location within the sail compartment. Generally, the solid rod type assembly shown in the illustrated embodiment has proven highly effective and is preferable. However, adaptation of other such headsail furling assemblies is well within the ordinary skill in the art.

The means for tensioning the furling rod may vary. In the illustrated embodiment, a simple mechanical turnbuckle is employed. Other such devices may be utilized including manually actuatable ratchet mechanisms and hydraulic mechanisms.

If the mast is stepped on deck or the cabin, it is clear that the tensioning mechanism must be located above the deck (or cabin) level and accordingly, the furling pulley assembly will have to be located thereabove. If the mast is stepped on the keel, then the tensioning mechanism may be located below the deck or cabin top, thus allowing the pulley mechanism to be disposed adjacent the cabin for the most convenient lead for the furling line. When the mast is keel stepped, it can be seen that operating mechanism below deck is readily accessible through the opening in the aft end of the mast.

In the illustrated embodiment, a manually actuatable furling pulley is utilized. It will be appreciated that a motorized assembly may also be employed if so desired.

The means for hoisting the mainsail on the sail furling rod may vary. In the illustrated embodiment, the normal mainsail halyard has been used to elevate the head collar 62 and the mainsail into its fully hoisted position. If so desired, an auxiliary halyard may be used for this purpose including one provided as a part of the furling rod assembly.

The slideways in the mast provide an extremely convenient means for carrying a sail cover to protect the furled mainsail within the sail compartment from ultraviolet degradation and other atmospheric conditions as well as to protect the internal operating mechanism. Any other halyard, or even the boom topping lift, may be utilized to hoist the sail cover into its fully hoisted position. Moreover, as has been indicated, either slideway may be utilized to carry and hoist an auxiliary sail or even the principal mainsail which, if difficulty occurs with the furling rod assembly, can be removed from the furling rod and inserted into a slideway.

Thus, it can be seen that the mast assembly of the present invention may be readily fabricated and readily serviced to provide highly effective means for internally furling the mainsail within the mast. The assembly is relatively rugged to provide long life and has the bulk of its operating components disposed within the confines of the mast. Moreover, the mast assembly permits hoisting a sail cover to protect the mainsail furled within the mast and for hoisting another sail in slideways provided at its aft end.

Having thus described the invention, we claim:

1. In a mainsail furling mast assembly, the combination comprising:

A. a mast having a cross section defined by a curvilinear outer wall of generally C-shaped configuration and a transverse wall intermediate the length of said cross section, such transverse wall and outer wall defining a sail receiving compartment with an opening at the rear of said mast extending over substantially its entire length, said opening having a width equal to at least 50 percent of the maximum width of said cross section of said mast;

B. a sail furling element in said cavity supported at its upper and lower ends in said sail receiving compartment for rotation therewithin, said furling element being substantially smaller in cross section than the width of said compartment opening to permit removal of the associated sail furling element within the sail furled thereabout by movement generally radially outwardly of said compartment through said opening over substantially the entire length of said furling element; and C. means on said sail furling element within said compartment for rotation of said furling element in either direction of rotation.

2. The furling mast assembly of claim 1 wherein the cross section includes rearwardly and outwardly extending diagonal reinforcing wall portions at the forward side margins of said compartment extending between said transverse wall and outer wall.

3. The furling mast assembly of claim 1 wherein said mast is fabricated in two sections with overlapping sidewall portions secured together, the forward one of said sections being substantially U-shaped in configuration and the rearward one of said sections having a cross section defined by a pair of generally curvilinear sidewall portions and a transverse wall portion extending therebetween intermediate the length of said sidewall portions.

4. The furling mast assembly of claim 3 wherein said mast sections are of substantially equal length in the horizontal dimension.

5. The furling mast assembly of claim 1 wherein said outer wall of said mast has enlarged rear end portions extending vertically therealong and providing vertically extending slideways having a rearwardly opening slot with an opening of lesser dimension than the cross section of the cavity in said slideway.

6. The furling mast assembly of claim 1 wherein said mast includes a masthead box providing a base plate extending across the upper end of said compartment, said plate having means thereon detachably engaged with the upper end of said furling element.

7. The furling mast assembly of claim 1 additionally including a collar assembly slidable on said furling element and having an upper portion with halyard engaging means thereon and a second portion depending therefrom and rotatable relative to said first portion, said second portion having means thereon for engagement of the head of the sail, whereby a mainsail may be hoisted upwardly by hoisting of said collar assembly.

8. The furling mast assembly of claim 1 wherein said furling element is of generally C-shaped cross section providing a vertically extending slot opening into a cavity of greater cross section than said slot for slidably seating the luff of a mainsail.

9. The furling mast assembly of claim 1 wherein said assembly includes tensioning means in said compartment below said pulley means and engaged with the lower end of said furling element, said tensioning means being adjustable to vary the tension on said furling element.

10. The furling mast assembly of claim 9 wherein said tensioning means comprises a turnbuckle assembly.

11. The furling mast assembly of claim 9 wherein said tensioning means comprises a hydraulic cylinder and piston/rod element and means for supplying hydraulic fluid to said cylinder at either end of said piston/rod element.

12. The furlin mast assembly of claim 1 wherein furling element rotating means comprises a pulley secured on said furling element for rotation therewith and wherein said mast assembly includes furling line guide means on said mast, said guide means including a bracket secured to said mast and extending rearwardly of said mast opening and guide means supported on said bracket in horizontal alignment with said pulley on said furling element.

13. The furling mast assembly of claim 1 wherein said mast includes a gooseneck mounting bracket having a reinforcement portion having a section of generally U-shaped configuration extending within said mast compartment with its web portion abutting said transverse wall, said reinforcement portion additionally including a pair of flange sections extending forwardly along the outer surface of said outer wall on both sides of said opening in said mast, and means securing said reinforcement portion to said outer walls of said mast.

14. The furling mast assembly of claim 13 wherein said gooseneck mounting bracket includes rearwardly extending flanges at its top and bottom ends and providing said gooseneck fitting.

15. The furling mast assembly of claim 1 wherein said opening in said mast is equal to at least 65 percent of the maximum width of said cross section of said mast.

16. In a mainsail furling mast assembly, the combination comprising:

A. a mast having a cross section defined by a curvilinear outer wall of generally C-shaped configuration and a transverse wall intermediate the length of said cross section, such transverse wall and outer wall defining a sail receiving compartment with an opening at the rear of said mast extending over substantially its entire length, said opening having a width equal to at least 50 percent of the maximum width of said cross section of said mast;

B. a sail furling element in said cavity supported at its upper and lower ends in said sail receiving compartment for rotation therewithin, said furling element being substantially smaller in cross section than the width of said compartment opening;

C. means on said sail furling element within said compartment for rotation of said furling element in either direction of rotation;

D. a boom mounting bracket on said mast;

E. a boom mounted on said boom mounting bracket;

F. a mainsail having its foot slidably mounted on said boom and its luff slidably mounted on said furling element, said mainsail being furlable about said furling element in the hoisted position thereof and the assembly of said furled sail and furling element being removable from said compartment by movement generally radially outwardly of said compartment through said compartment opening over substantially the entire length of said furling element; and G. means for hoisting said mainsail on said sail furling element to adjacent the top of said mast.

17. The furling mast assembly of claim 16 wherein a portion of said mainsail is rolled about said sail furling element.

18. The furling mast assembly of claim 16 wherein said mainsail is substantially fully rolled about said furling element.

19. The furling mast assembly of claim 16 wherein said outer wall of said mast has enlarged rear end portions extending vertically therealong and providing vertically extending slideways having a rearwardly opening slot with an opening of lesser dimension than the cross section of the cavity in said slideway.

20. The furling mast assembly of claim 19 wherein said mainsail is substantially furled about said furling element, and wherein there is included a sail cover having its vertical edge portions slidably seated in said slideways and extending across said mast opening and said mainsail in said compartment, and halyard means hoisting said sail cover to adjacent the top of said mast.

21. The furling mast assembly of claim 16 wherein there is included a second sail having its luff seated in and extending along one of said slideways and its foot extending aftward from said mast, and halyard means hoisting said second sail to a fully raised position.

22. The furling mast assembly of claim 16 wherein said boom mounting bracket has a reinforcement portion with a section of generally U-shaped configuration extending within said mast compartment with its web portion abutting said transverse wall, said reinforcement portion additionally including a pair of flange sections extending forwardly along the outer surface of said outer wall on both sides of said opening in said mast, and means securing said reinforcement portion to said outer walls of said mast.

23. The furling mast assembly of claim 22 wherein said boom mounting bracket includes rearwardly extending flanges at its top and bottom ends and providing said gooseneck fitting.

* * * * *